US005427267A

United States Patent [19]

Willman

[11] Patent Number: 5,427,267

[45] Date of Patent: Jun. 27, 1995

[54] CONTAINER WITH INNER BAG SEALING FEATURE

[76] Inventor: Samuel A. Willman, R.D. 1, Box 450A, Red Line, Pa. 17356

[21] Appl. No.: 272,756

[22] Filed: Jul. 11, 1994

[51] Int. Cl.[6] ..... B65D 5/06; B65D 5/60

[52] U.S. Cl. ..... 220/403; 220/404; 220/410; 493/100; 493/907

[58] Field of Search ..... 220/403, 404, 408, 410, 220/462, 465; 229/217-219; 493/100, 907

[56] References Cited

U.S. PATENT DOCUMENTS

| | | | |
|---|---|---|---|
| 2,946,494 | 7/1960 | Kuss | 220/462 |
| 3,178,064 | 4/1965 | Layne | 220/465 |
| 3,179,323 | 4/1965 | Miller | 220/462 |
| 3,206,094 | 9/1965 | Humphrey et al. | 220/462 |
| 3,322,320 | 5/1967 | Beadle | 220/403 |
| 3,576,290 | 4/1971 | Marchisen . | |
| 4,174,051 | 11/1979 | Edwards et al. | 220/462 |
| 4,266,668 | 5/1981 | Paek . | |
| 4,610,039 | 9/1986 | Stern . | |
| 4,674,676 | 6/1987 | Sandel et al. . | |
| 4,676,394 | 6/1987 | Hiersteiner | 220/410 |
| 4,872,588 | 10/1989 | Texidor | 220/403 |
| 4,890,761 | 1/1990 | Gaves . | |
| 4,905,898 | 3/1990 | Wade | 220/403 |
| 5,054,644 | 10/1991 | Greenslade | 220/462 |
| 5,265,753 | 11/1993 | Moorman | 220/462 |

FOREIGN PATENT DOCUMENTS

| | | |
|---|---|---|
| 493047 | 5/1978 | Australia . |
| 2395913 | 1/1979 | France . |
| 4108254 | 9/1992 | Germany . |

*Primary Examiner*—Gary E. Elkins
*Attorney, Agent, or Firm*—Dowell & Dowell

[57] ABSTRACT

A container suitable for enclosing and sealing an inner storage bag is disclosed. The container includes a plurality of side walls, an outer flap and an inner flap. A removable tab is provided in the inner flap adjacent to one of the side walls and defined by a weakened line which is adapted to be broken to form an opening through the inner flap. The opening is shaped to easily receive the twisted neck of the inner bag and, once inserted, to seal the neck and prevent it from becoming untwisted. The seal is further enhanced by inserting the twisted neck between the inner flap and one side wall, and closing the outer flap.

20 Claims, 2 Drawing Sheets

CONTAINER WITH INNER BAG SEALING FEATURE

BACKGROUND OF THE INVENTION

The invention is directed to the field of containers, and, more particularly, to a shipping container suitable for use with flexible inner storage bags filled with powdered, granulated or pelletized products.

It is well known to package and ship powdered, granulated or pelletized products in flexible plastic storage bags placed within shipping containers. The open ends of the storage bags are conventionally closed by twist ties or pressure sensitive tape. Such closing elements have proven inadequate, however, for a number of reasons.

First, twist ties or pressure sensitive tape commonly become separated from the storage bags during shipping. Consequently, when the containers are emptied, the separated ties or tape may be later introduced into the processing equipment such as sifters and jam the equipment. In the case of food products, the products may be contaminated by the separated sealing elements.

Second, the conventional twist ties generally do not adequately seal the inner bags so as to prevent the food products from leaking. As a result of leakage, products are lost. For large producers, such product losses can become significant over a period of time, resulting in lost income.

In addition, inadequately sealed inner bags allow the food products to lose their freshness in a shortened period of time. Consequently, after being shipped and packaged, the food products may have a reduced shelf life for the consumer.

Thirdly, twist ties and the like represent an additional production expense.

SUMMARY OF THE INVENTION

The present invention has been made in view of the above-explained inadequacies of the known shipping containers and has as an object to provide a container which can be used to enclose and seal a flexible inner bag containing powdered, granulated or pelletized products without requiring sealing elements such as ties or pressure sensitive tape.

A further object of the invention is to provide a method of sealing an inner bag within a shipping container in accordance with the invention without the need for such sealing elements.

Additional objects and advantages of the present invention will become apparent from the description which follows, considered in conjunction with the accompanying drawing figures, or by practice of the invention.

To achieve the objects of the invention, as embodied and broadly described herein, the container in accordance with a preferred embodiment of the invention comprises a plurality of side walls, an outer flap and an inner flap. The inner flap includes a removable tab disposed adjacent to one of the side walls. The tab is defined by a weakened line which is adapted to be broken to form an opening through the inner flap. The tab has a first portion, a second portion and an intermediate portion connecting said first and second portions and having a lesser width than the first and second portions.

A method of sealing an inner bag within a container in accordance with the preferred embodiment of the invention is also disclosed. In the method, a flexible inner bag having a neck is placed within the container and the tab in the inner flap is removed to form an opening therethrough. The neck is twisted and inserted through the opening such that the twisted neck extends exteriorly of the inner flap. Next, the twisted neck is folded toward one side wall and a terminal portion of the twisted neck is inserted between the inner flap and one side wall. Finally, the outer flap is closed to cover the twisted neck and prevent it from becoming untwisted. In this condition, the twisted neck is secured by the inner flap, the one side wall and the outer flap, and the contents of the inner bag are sealed.

DETAILED DESCRIPTION OF THE PREFERRED EMBODIMENT

Figure 1:
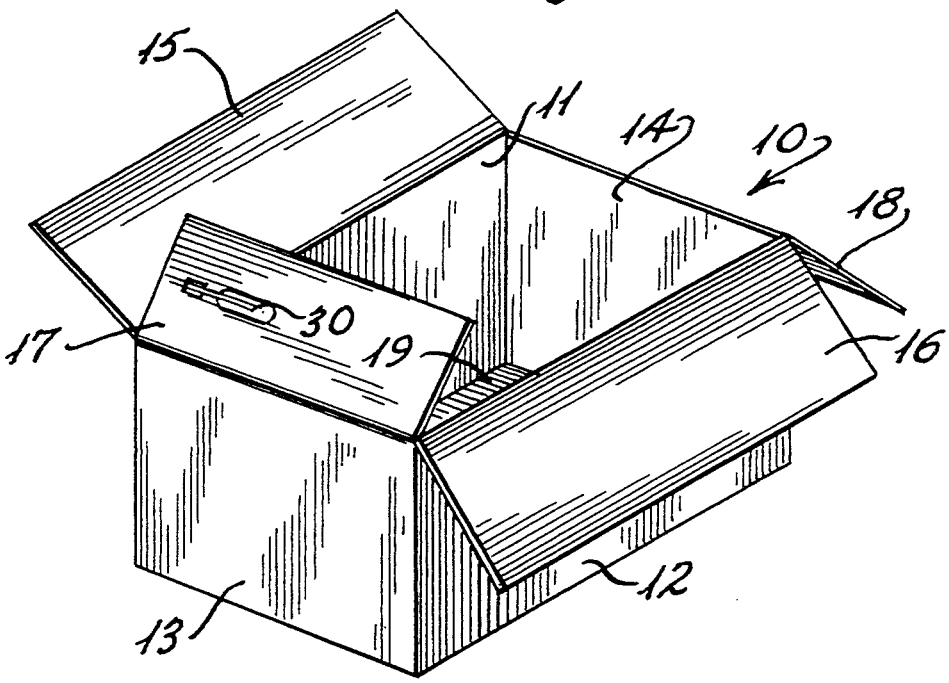
FIG. 1 is an isometric view of a shipping container in accordance with a preferred embodiment of the invention.

With reference to the drawing figures, FIG. 1 illustrates a container 10 in accordance with a preferred embodiment of the invention. The container is preferably composed of corrugated cardboard or a like material, having sufficient rigidity for use as a shipping container. The container includes opposed side walls 11, 12; end walls 13, 14; outer flaps 15, 16 extending from the side walls 11, 12, respectively; inner flaps 17, 18 extending from the end walls 13, 14, respectively; and bottom wall 19.

Figure 2:
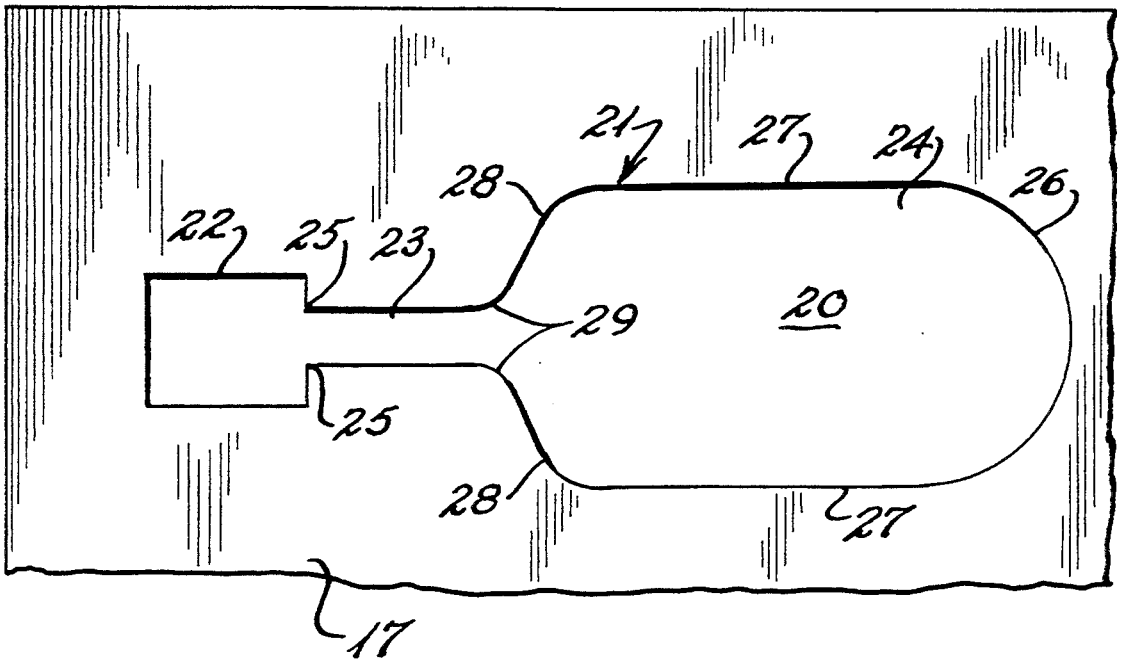
FIG. 2 is an enlarged top plan view of the opening in the inner flap of the container of FIG. 1.

A removable tab 20 is provided in inner flap 17 as shown in an enlarged view in FIG. 2. The tab is preferably disposed adjacent to the side wall 11 and oriented substantially perpendicular to the side wall. The tab includes three portions which are defined by a weakened line 21. The weakened line is easily broken to remove the tab from the inner flap 17 to form an opening 30 of the same shape (see FIG. 1). The three portions of the tab are first end portion 22, second intermediate portion 23 and third end portion 24. The first portion 22 is preferably rectangular or square shaped and the second portion 23 is preferably rectangular shaped and forms a neck between the first and third portions. The corners 25 of the tab preferably form a right angle at the entrance of the first portion. The third portion 24 is larger in size than the first and second portions. The third portion is defined by an arcuate rear portion 26, an intermediate straight portion 27 and a curved front portion 28 having inwardly convex corners 29 at the entrance to the neck.

Figure 3:
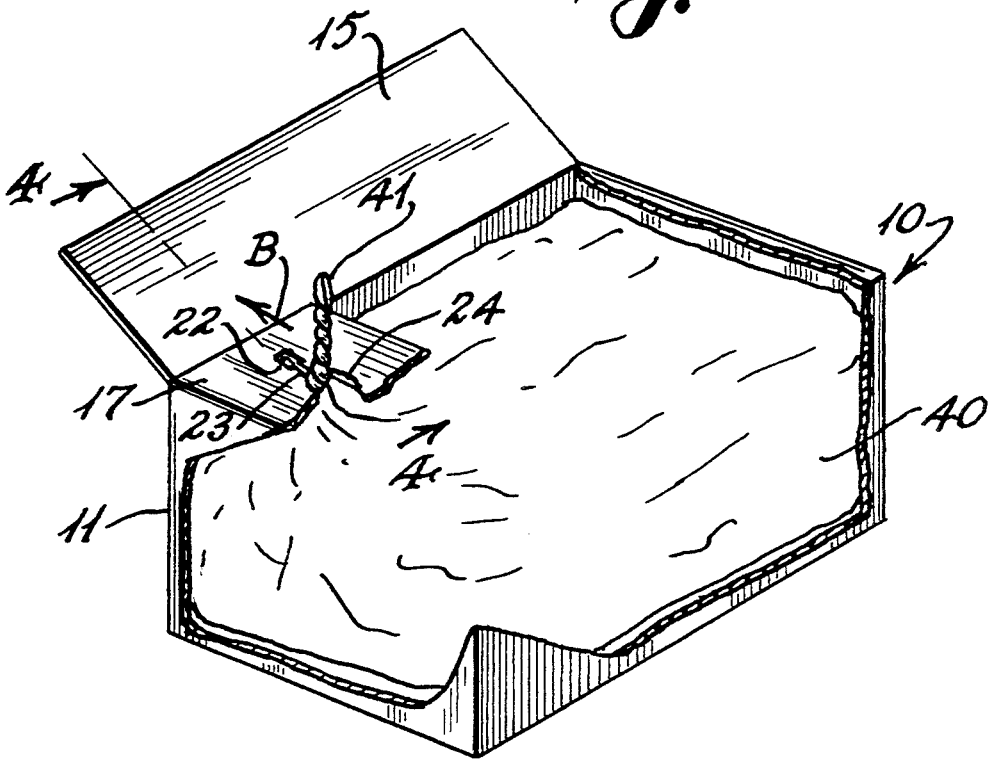
FIG. 3 is a partially broken away illustrational view of the manner of securing the twisted neck of an inner storage bag through the opening in the inner flap of the container of FIG. 1.

FIG. 3 illustrates the container 10 in accordance with the invention enclosing an inner bag 40 which is preferably composed of a flexible plastic material. The inner bag may contain powdered, granulated or pelletized substances for human or animal consumption. The substances may also be products for industrial use such as cleaning products and metal powders. Such food and industrial products are characterized as being fluid and having a tendency to leak from inner bags that are inadequately sealed.

Figure 4:
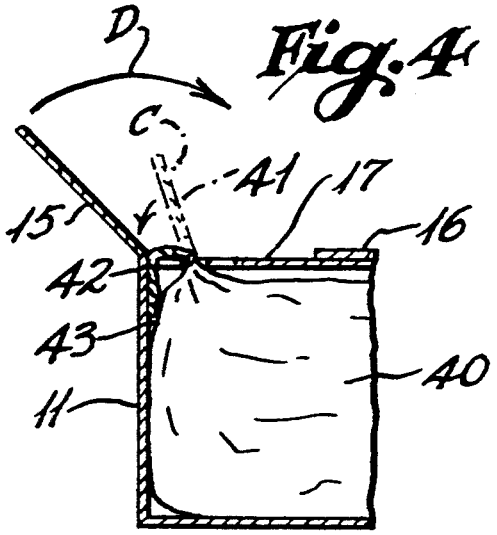
FIG. 4 is a partial cross-sectional view in the direction of line 4—4 of FIG. 3 illustrating the manner of inserting the twisted neck of the inner storage bag between an outer edge of the inner flap and a side wall and the closing of an outer flap to cover the twisted neck.
Figure 5:
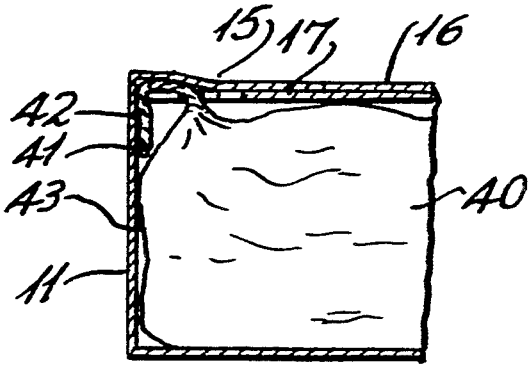
FIG. 5 is an illustrational view similar to FIG. 4 in which the outer flap is closed to secure the twisted neck of the inner storage bag.

The container 10 is designed such that the inner bag 40 can be easily sealed within the container without requiring the use of additional sealing elements such as bag ties or pressure sensitive tape. The manner of sealing the inner bag within the container is illustrated in FIGS. 3–5. Referring to FIG. 3, with the outer flap 15 opened, the neck 41 of the inner bag forming an opening is twisted and inserted upwardly through the third portion 24 of the opening 30 formed by removing the tab 20. The neck 41 is then pulled along the opening in the direction of arrow "B". The rounded corners 29 of the opening allow the neck to be pulled into the second portion 23 with minimal resistance from the wall of the opening. The neck is pulled into the first portion 22 at the end of the opening, and there the rectangular or square shape provides resistance to the neck becoming untwisted, and also substantially prevents the inner bag from reentering the second portion. The inner bag is sealed once it is secured in the first portion of the opening.

With reference to FIG. 4, the neck 41 of the inner bag 40 is next folded over in the direction of arrow "C" and inserted between the inner flap 17 and the side wall 11 of the container, such that the terminal portion 42 of the neck extends downward into the space 43 between the inner bag and the side wall 11.

Referring to FIG. 5, the outer flap 15 is closed as indicated by arrow "D" to cover the inner flap and secure the neck and prevent it from becoming untwisted. The neck is pinched by the inner flap, side wall and outer flap to form a secondary seal to further prevent the contents of the inner bag from leaking out during shipping. Finally, the outer flaps are secured in the closed position by an adhesive, shipping tape, or conventional fasteners such as staples.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A container comprising:
a plurality of side walls;
an outer flap; and
an inner flap including a removable tab disposed adjacent to one of said side walls, said tab being defined by a weakened line which is adapted to be broken to form an opening through said inner flap, said tab having a first portion, a second portion and an intermediate portion connecting said first and second portions and having a lesser width than said first and second portions.

2. The container of claim 1, wherein said first portion and said intermediate portion of said tab are each rectangular shaped and form opposed square corners at a first end of said intermediate portion.

3. The container of claim 2, wherein said weakened line is convex and rounded toward the interior of said tab at a second end of said intermediate portion.

4. The container of claim 3, wherein said tab is oriented substantially perpendicular to said one side wall.

5. The container of claim 1, being composed of a cardboard material.

6. In combination:
a container comprising:
a plurality of side walls;
an outer flap; and
an inner flap including a removable tab disposed adjacent to one of said side walls, said tab being defined by a weakened line which is adapted to be broken to form an opening through said inner flap, said tab having a first portion, a second portion and an intermediate portion connecting said first and second portions and having a lesser width than said first and second portions; and
a flexible bag disposed within said container, said bag having a neck of a sufficient length to extend through said opening and exteriorly of said inner flap when said tab is removed and to be inserted between said inner flap and said one side wall.

7. The combination of claim 6, wherein said first portion and said intermediate portion of said tab are each rectangular shaped and form opposed square corners at a first end of said intermediate portion.

8. The combination of claim 7, wherein said weakened line is convex and rounded toward the interior of the tab at a second end of said intermediate portion.

9. The combination of claim 8, wherein said tab is oriented substantially perpendicular to said one side wall.

10. The combination of claim 6, wherein said container is composed of corrugated cardboard.

11. The combination of claim 10, wherein said bag is composed of a plastic material.

12. A method comprising the steps of:
providing a container comprising:
a plurality of side walls;
an outer flap; and
an inner flap including a removable tab disposed adjacent to one said side wall, said tab being defined by a weakened line which is adapted to be broken to form an opening through said inner flap;
placing a flexible inner bag having a neck within said container;
removing said tab to form an opening through said inner flap;
twisting said neck of said inner bag;
inserting the twisted neck through said opening such that the twisted neck extends exteriorly of said inner flap;
folding the twisted neck toward said one side wall and inserting a terminal portion of the twisted neck between said inner flap and said one side wall; and
closing said outer flap to cover said twisted neck.

13. The method of claim 12, wherein said tab includes a first portion, a second portion and an intermediate portion connecting said first and second portions and having a lesser width than said first and second portions, said step of inserting comprises inserting the twisted neck of the inner bag through said second portion and pulling the twisted neck through said intermediate portion and into said first portion to seal the twisted neck.

14. The method of claim 13, wherein the step of closing, the closed outer flap prevents said twisted neck from becoming untwisted, and said twisted neck is secured by said inner flap, said one side wall and said outer flap.

15. The method of claim 13, wherein said weakened line is convex and rounded toward the interior of the tab at a second end of said intermediate portion such that said twisted neck of said inner bag is pulled into said intermediate portion with reduced resistance.

16. The method of claim 15, wherein said first portion and said intermediate portion of said tab are each rectangular shaped and form opposed square corners at a first end of said intermediate portion, and said first portion substantially prevents said twisted neck of said inner bag from untwisting and said square corners substantially prevent said twisted portion from reentering said intermediate portion.

17. The method of claim 12, wherein said tab is oriented substantially perpendicular to said one side wall.

18. The method of claim 12, wherein said container is composed of corrugated cardboard.

19. The method of claim 18, wherein said inner bag is composed of a plastic material.

20. The method of claim 12, wherein said inner bag contains a substance selected from the group consisting of powdered, granulated and pelletized substances.

* * * * *

US005427267B1

REEXAMINATION CERTIFICATE (3195th)

United States Patent [19] [11] B1 5,427,267

Willman [45] Certificate Issued May 13, 1997

[54] CONTAINER WITH INNER BAG SEALING FEATURE

[76] Inventor: Samuel A. Willman, R.D. 1, Box 450A, Red Line, Pa. 17356

Reexamination Request:
No. 90/004,309, Jul. 17, 1996

Reexamination Certificate for:

| | |
|---|---|
| Patent No.: | **5,427,267** |
| Issued: | **Jun. 27, 1995** |
| Appl. No.: | **272,756** |
| Filed: | **Jul. 11, 1994** |

[51] Int. Cl.[6] ..... B65D 5/06; B65D 5/60

[52] U.S. Cl. ..... 220/403; 220/404; 220/410; 493/100; 493/907

[58] Field of Search ..... 220/403, 404, 220/408, 410, 462, 465

[56] References Cited

U.S. PATENT DOCUMENTS

| | | | |
|---|---|---|---|
| 2,015,653 | 10/1935 | Andrews . | |
| 2,017,176 | 10/1935 | Andrews . | |
| 2,946,494 | 7/1960 | Kuss | 220/462 |
| 3,051,367 | 8/1962 | Einhorn . | |
| 3,178,064 | 4/1965 | Layne | 220/465 |
| 3,179,323 | 4/1965 | Miller | 220/462 |
| 3,206,094 | 9/1965 | Humphrey et al. | 220/462 |
| 3,322,320 | 5/1967 | Beadle | 220/403 |
| 3,576,290 | 4/1971 | Marchisen . | |
| 3,578,234 | 5/1971 | Marchisen . | |
| 4,174,051 | 11/1979 | Edwards et al. | 220/462 |
| 4,266,668 | 5/1981 | Paek . | |
| 4,610,039 | 9/1986 | Stern . | |
| 4,673,125 | 6/1987 | Weaver . | |
| 4,674,676 | 6/1987 | Sandel et al. . | |
| 4,676,394 | 6/1987 | Hiersteiner | 220/410 |
| 4,815,631 | 3/1989 | Eeg et al. . | |
| 4,872,588 | 10/1989 | Texidor | 220/403 |
| 4,890,761 | 1/1990 | Gaves . | |
| 4,905,898 | 3/1990 | Wade | 220/403 |
| 5,042,682 | 8/1991 | Ritter et al. . | |
| 5,054,644 | 10/1991 | Greenslade | 220/462 |
| 5,265,753 | 11/1993 | Moorman | 220/462 |

FOREIGN PATENT DOCUMENTS

| | | |
|---|---|---|
| 493047 | 5/1978 | Australia . |
| 2395913 | 1/1979 | France . |
| 4108254 | 9/1992 | Germany . |

*Primary Examiner*—Gary E. Elkins

[57] ABSTRACT

A container suitable for enclosing and sealing an inner storage bag is disclosed. The container includes a plurality of side walls, an outer flap and an inner flap. A removable tab is provided in the inner flap adjacent to one of the side walls and defined by a weakened line which is adapted to be broken to form an opening through the inner flap. The opening is shaped to easily receive the twisted neck of the inner bag and, once inserted, to seal the neck and prevent it from becoming untwisted. The seal is further enhanced by inserting the twisted neck between the inner flap and one side wall, and closing the outer flap.

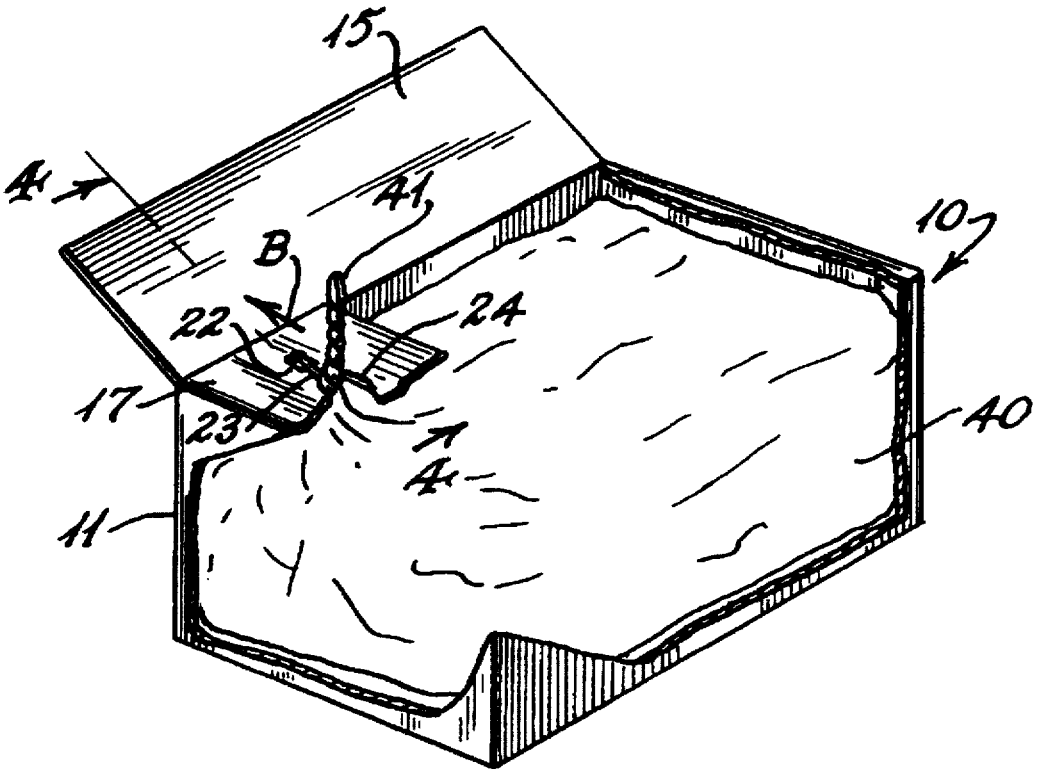

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *